US006676036B2

(12) United States Patent
Anderson et al.

(10) Patent No.: US 6,676,036 B2
(45) Date of Patent: Jan. 13, 2004

(54) METHODS AND APPARATUS PROVIDING DUAL ADVANCE OF A FLUID EJECTOR SYSTEM RELATIVE TO A RECEIVING MEMBER

(75) Inventors: David G. Anderson, Ontario, NY (US); Kevin Michael Carolan, Webster, NY (US); David T. Zawadzki, Westborough, MA (US)

(73) Assignee: Xerox Corporation, Stamford, CT (US)

( * ) Notice: Subject to any disclaimer, the term of this patent is extended or adjusted under 35 U.S.C. 154(b) by 99 days.

(21) Appl. No.: 09/840,926

(22) Filed: Apr. 25, 2001

(65) Prior Publication Data

US 2002/0158144 A1 Oct. 31, 2002

(51) Int. Cl.[7] ..... B05B 3/00; B05B 1/08; B05B 3/04; B41J 29/38; B41J 23/00

(52) U.S. Cl. ..... 239/227; 239/102.2; 239/225.1; 239/264; 347/12; 347/37

(58) Field of Search ..... 239/102.1, 102.2, 239/722, 750, 752, 225.1, 263.3, 264, 265, 227, 243, 751; 347/12, 40, 43, 86, 37, 42; 400/58, 56, 57

(56) References Cited

U.S. PATENT DOCUMENTS 4,517,576 A * 5/1985 Sugawara ..... 346/139 R
4,533,922 A * 8/1985 Tanaka ..... 346/49
5,428,375 A * 6/1995 Simon et al. ..... 347/12
5,488,397 A 1/1996 Nguyen et al. ..... 347/40
5,861,899 A 1/1999 Nguyen et al. ..... 347/40
6,161,914 A 12/2000 Haselby ..... 347/19
6,390,106 B1 * 5/2002 Lin ..... 134/172
6,431,773 B1 * 8/2002 Plumley et al. ..... 400/120.16

* cited by examiner

*Primary Examiner*—Michael Mar
*Assistant Examiner*—Darren Gorman
(74) *Attorney, Agent, or Firm*—Oliff & Berridge, PLC

(57) ABSTRACT

A fluid ejecting method and system include one or more fluid ejectors within a fluid ejector frame and an interposer frame and movably mounted upon a fluid ejector carriage. The fluid ejector carriage traverses across a recording medium for placing swaths of fluid droplets upon the recording medium. A biasing structure urges the fluid ejector frame to a first position to obtain highly accurate and repeatable placement of fluid droplets when the fluid ejector frame is in the first position. A second position of the fluid ejector frame is achieved by energizing a position actuator to move the fluid ejector frame from the first position to the second position to obtain highly accurate and repeatable placement of fluid droplets when the fluid ejector frame is in the second position. The recording medium is advanced separately upon completing a set of at least one swath of fluid droplets.

20 Claims, 5 Drawing Sheets

METHODS AND APPARATUS PROVIDING DUAL ADVANCE OF A FLUID EJECTOR SYSTEM RELATIVE TO A RECEIVING MEMBER

BACKGROUND OF THE INVENTION

1. Field of Invention

This invention relates to mechanisms and methods for advancing a fluid ejection system relative to a receiving medium.

2. Description of Related Art

Partial width fluid ejection systems are known to use an advance mechanism that advances a receiving medium relative to a fluid ejector head in a process, or slow scan, direction in conjunction with a carriage that moves along a fast scan direction to facilitate ejecting fluid onto the receiving medium. In a typical fluid ejecting system using this combination of movements between the advance mechanism and the carriage, the advance mechanism moves the receiving medium in a direction perpendicular to the direction of movement of the carriage along the fast scan direction. The carriage houses at least one fluid ejector having a plurality of fluid-ejecting nozzles from which droplets of fluid are placed on the receiving medium in swaths according to the transversing movement of the carriage in the fast scan direction across the receiving medium. The receiving medium advance motion and the carriage motion are coordinated to the extent that the receiving medium advance is stopped while the carriage travels across the receiving medium to place fluid upon the receiving medium.

A variety of configurations have been used to date to provide the dual motions necessary for placing the ejecting fluid upon the receiving medium using a carriage. For example, some known systems use a servo-system including an encoder to accurately move a receiving medium in two modes. The first mode advances the receiving medium a designated distance at the completion of each swath of ejected fluid from the one or more fluid ejector on the carriage. The servo motor provides the first motion mode for advancing the receiving medium. The servo motor provides a second, finer, motion mode to the receiving medium as well. The second, finer, motion mode positions the receiving medium a necessary, though relatively smaller, distance compared to the first advance distance the receiving medium is moved as provided by the servo-motor. The second, finer, motion aligns the recording medium relative to the one or more fluid ejector for receiving second, or subsequent, swaths off fluid ejected from the one or more fluid ejector.

Thus, the dual movements in this servo-motor system require fairly precise co-ordination between the servo-motor and the receiving medium relative to the one or more fluid ejectors. However, servo-motors are prone to deviations in placing the receiving medium, resulting in less accurate placement of fluid upon the receiving medium. Moreover, in those servo-motor printing systems that move the receiving medium in the advance directions in two modes, the accuracy of movement is questionable as well, since it is very difficult to move the receiving medium consistently in the second mode the designated distance W when the distance is an increment perhaps as small as 1/600 inch. Moving the recording media such a small distance requires precision media drive rolls, gears, encoders and motors, which add to the cost and complexity of a fluid ejecting system. Moreover, the flexible qualities of recording media render recording media susceptible to positioning variations that are difficult to predict or compensate for, even in a fluid ejecting system that uses high precision elements. A stepper motor could also be used to perform the same dual motions. However, the same or similar problems often occur in stepper motor systems.

Alternatively, some known fluid ejecting systems use a ball and screw carriage advance mechanism, as opposed to the recording media advance mechanism discussed above. The ball and screw carriage advance mechanism is used with a high degree stepping motor that incrementally moves the fluid ejectors when the carriage has completed placing a swath of fluid upon a receiving media. In such a system, the carriage is moved along support rails by operating the ball and screw, to scan the carriage across the receiving medium. The receiving medium remains stationary thoughout the fluid ejecting process. Thus, all the movements in this ball and screw type printing system are by the carriage and fluid ejectors.

A more recent trend among fluid ejecting systems is to use the same general configurations as discussed above, but to increase the number of ejecting nozzles on the fluid ejector while using the same fluid ejector dimensions. The increase in fluid-ejecting nozzles results in a resolution as high as 600 dots per inch (dpi) versus the standard 300 dpi resolution used in earlier fluid ejecting systems. However, the increased number of fluid-ejecting nozzles is not easily achieved. In particular, the precision required for manufacturing fluid-ejecting nozzles has become increasingly more difficult to attain, since an increased number of nozzles is required to provide up to 600 dpi resolution on the same sized fluid-ejector that may have originally provided only enough nozzles for 300 dpi resolution. Thus, the nozzles necessarily become smaller and more difficult to make.

SUMMARY OF THE INVENTION

The above-described prior fluid ejecting systems provide variations of the dual motions along the advance direction needed by the carriage and its fluid ejectors relative to the receiving medium. The servo-motor systems provide movements quickly, but not necessarily accurately. The ball and screw systems provide accuracy but not quickness. Systems increasing the fluid ejecting nozzles on a standard dimensioned fluid ejector result in excess manufacturing and replacement costs.

Accordingly, a need exists for a fluid ejecting system providing a quick, accurate and inexpensive manner of achieving the necessary dual motions of the carriage and its fluid ejector relative to a receiving medium.

In various exemplary embodiments of the fluid ejecting system and methods of this invention, a fluid ejector and carriage are mounted within an interposer frame that is movable along support rails. A separate paper advance mechanism advances the receiving medium a designated distance when a swath is completed. In operation, the receiving medium advances to an initial position for receiving fluid from the fluid ejector, where the fluid ejector is in a first position within the interposer frame. The fluid ejector is biased against a first set of surfaces in the first position by a biasing element. This tends to ensure the fluid is consistently and accurately placed upon the receiving medium as droplets of fluid are ejected from the fluid ejector located in the first position as printing information upon the receiving medium. A spring, for example, may be used as the biasing element. With the fluid ejector in the first position, the carriage travels across the receiving medium, depositing droplets of fluid onto the receiving medium in a swath.

Upon completion of that swath, a position actuator, for example, is energized to urge the fluid ejector to a second position, where the fluid ejector is located against a second set of surfaces. In the second position, the fluid ejector ejects a second swath upon the receiving medium. Thus, whenever the fluid ejector is placed in the second position, the accuracy of placing fluid upon the receiving medium that is achieved is similar to the accuracy achieved by biasing the fluid ejector to the first position. The fluid placement accuracy is achieved regardless of the number, or direction, of swaths being ejected due to consistently placing the fluid ejector against the first and second sets of surfaces corresponding to the first and second positions, respectively.

After a pair of first and second swaths are completed, the receiving medium is advanced to a next position to perform another swath, or pair of swaths, as desired. Thus, the advancing of the receiving medium is easily co-ordinated with the completion of a swath. Moreover, the incremental movement of the fluid-ejector is easily and quickly performed to either of the first and second positions.

Sensors may be used to detect the positioning of the fluid ejector relative to the receiving media, or to provide feedback to a processing system, if, for example, variations in swath widths are desired or other positional information is needed to cause the position actuator to operate and move the fluid ejector to/from either of a first or second position, or to any other fractional part of the distance between either of the first or second positions. After completion of the desired swath or set of swaths, the receiving medium is advanced to place an additional swath or set of swaths of fluid upon the receiving medium as desired.

Alternatively, a fixed fluid ejector may be used in conjunction with an adjustable fluid ejector to place fluid upon a recording medium, wherein a sensor detects the alignment necessary for the adjustable fluid ejector to place fluid in an appropriate location upon the recording medium relative to the fluid placed upon the recording medium by the fixed fluid ejector. The sensor may be, for example, a position sensor using position sensing diodes, such as the position sensor made by Hammamatsu Inc., Japan. Many other sensor types can also be used; such as laser micrometers, or eddy current position sensors, for example.

Upon detection of the necessary alignment adjustment distance, at least one position actuator is energized to move the adjustable fluid ejector the necessary alignment distance to place fluid upon the recording medium in a swath subsequent to the swath of fluid placed upon the recording medium by the fixed fluid ejector. Similarly, as above, the receiving medium is advanced after completion of the swath or set of swaths of fluid upon the receiving medium, as desired.

In various exemplary embodiments, the system and methods according to this invention provides a sequence of synchronized dual motions that are easily performed and are accurately repeatable, while providing a relatively quick fluid ejection process. Moreover, this invention uses structures that are inexpensive to produce, maintain or replace.

These and other features and advantages of this invention are described in, or are apparent from, the detailed description of various exemplary embodiments of the systems and methods according to this invention.

BRIEF DESCRIPTION OF THE DRAWINGS

Various exemplary embodiments of this invention will be described in detail with reference to the following figures, wherein like numerals represent like elements, and wherein.

DETAILED DESCRIPTION OF PREFERRED EMBODIMENTS

Figure 1:
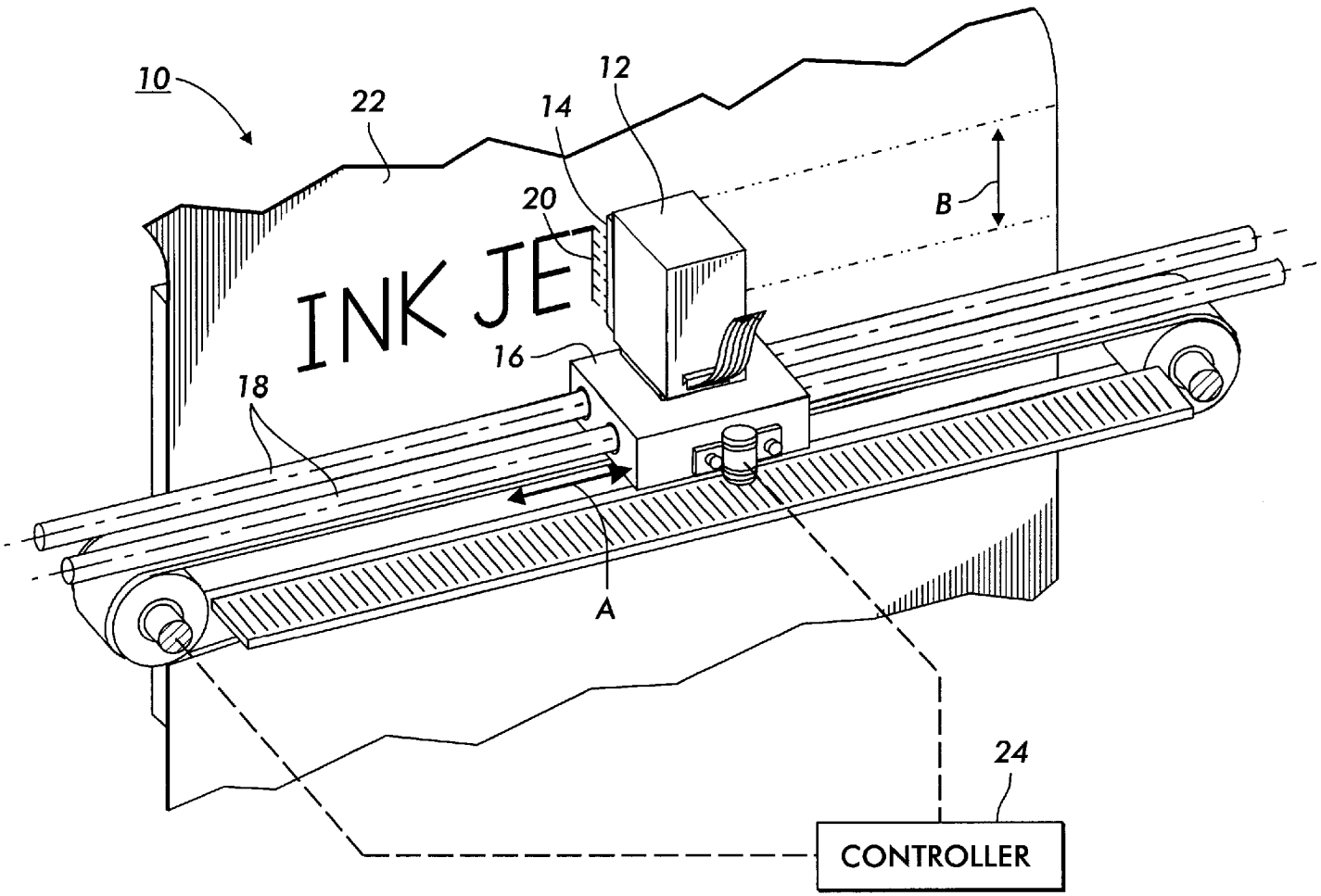
FIG. 1 is a cutaway view of a fluid-ejector and carriage mounted upon support Grails in a conventional fluid-ejecting system.

FIG. 1 shows a schematic view of one exemplary embodiment of an exemplary fluid ejection system 10. A fluid ejector 12 includes one or more linear arrays of fluid-droplet producing channels housed within one or more printheads 14. The fluid ejector 12 is mounted upon a reciprocal carriage 16 that is movable upon support rails 18. Fluid droplets 20 are placed, for example, as printing information, upon a recording medium 22 each time the fluid ejector 12 traverses across the recording medium 22 along a fast scan direction, or axis, A. At the completion of a swath, the recording medium 22 is then stepped, or moved, in a slow scan, or process, direction B to receive a next swath of the fluid droplets. Advancing the recording medium 22 may be achieved by a motorized take-up roll or any other appropriate known or later developed structures, apparatuses or devices. The fluid ejector 12 traverses across the recording medium 22 along the fast scan axis A, for example, by using any appropriate known or later developed drive mechanisms, structures or apparatuses. The drive mechanism may be operatively connected to a controller 24 to selectively cause the fluid ejector 12 and carriage 16 to traverse across the recording medium 22.

Figure 2:
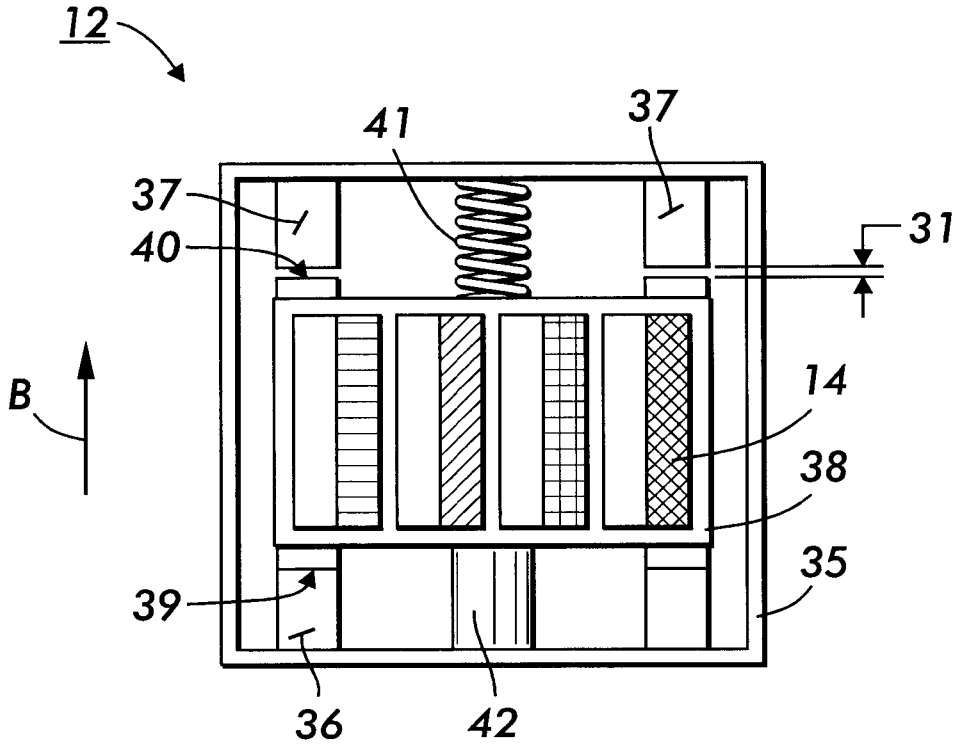
FIG. 2 illustrates one exemplary embodiment of the carriage and fluid-ejector structures according to this invention.

FIG. 2 shows one exemplary embodiment of the systems and methods for performing the motions of the fluid ejectors 14 and the fluid ejector carriage 12 according to this invention. The fluid ejector carriage 12 includes an interposer frame 35 having first and second pairs of surfaces 36 and 37 protruding from interior surfaces of, for example, the top and bottom sides of the interposer frame 35 with reference to direction B. A fluid ejector frame 38 is positioned within the interposer frame 35 and the protruding surfaces 36 and 37. The fluid ejector frame 38 includes first and second pairs of locator surfaces 39 and 40 that oppose the corresponding protruding surfaces 36 and 37, respectively.

The fluid ejector frame 38 is urged to either of a first position or a second position. The fluid ejector frame 38 is urged toward the first or second position by one or more biasing elements, such as for example, one or more springs 41. For example, the one or more springs 41 can thus bias the fluid ejector frame 38 and specifically the first pair of locator surfaces 39 against the corresponding protruding surfaces 36 of the interposer frame 35 to place the fluid ejector frame 38 into, for example, the first position. When in the first position, the locator surfaces 39 of the fluid ejector frame 38 abut securely against the corresponding protruding surfaces 36 of the interposer frame 35. At the same time, a gap 31 exists between the upper portion of the fluid ejector frame 38 such that the locator surfaces 40 are, for example, 1/600 inch apart from the corresponding protruding surfaces 37 of the interposer frame 35.

Upon completion of, for example, a first pass of a current swath, a position actuator 42 is energized to urge the fluid ejector frame 38 towards the second position. In this second position, the spring 41 is compressed and the fluid ejector frame 38 moves to close the gap 31 such that the locator surfaces 40 abut securely against the corresponding protruding surfaces 37 of the interposer frame 35. At the same time, the gap 31 is provided between the lower locator surfaces 39 and the corresponding protruding surfaces 36 of the interposer frame 35.

Figure 3:
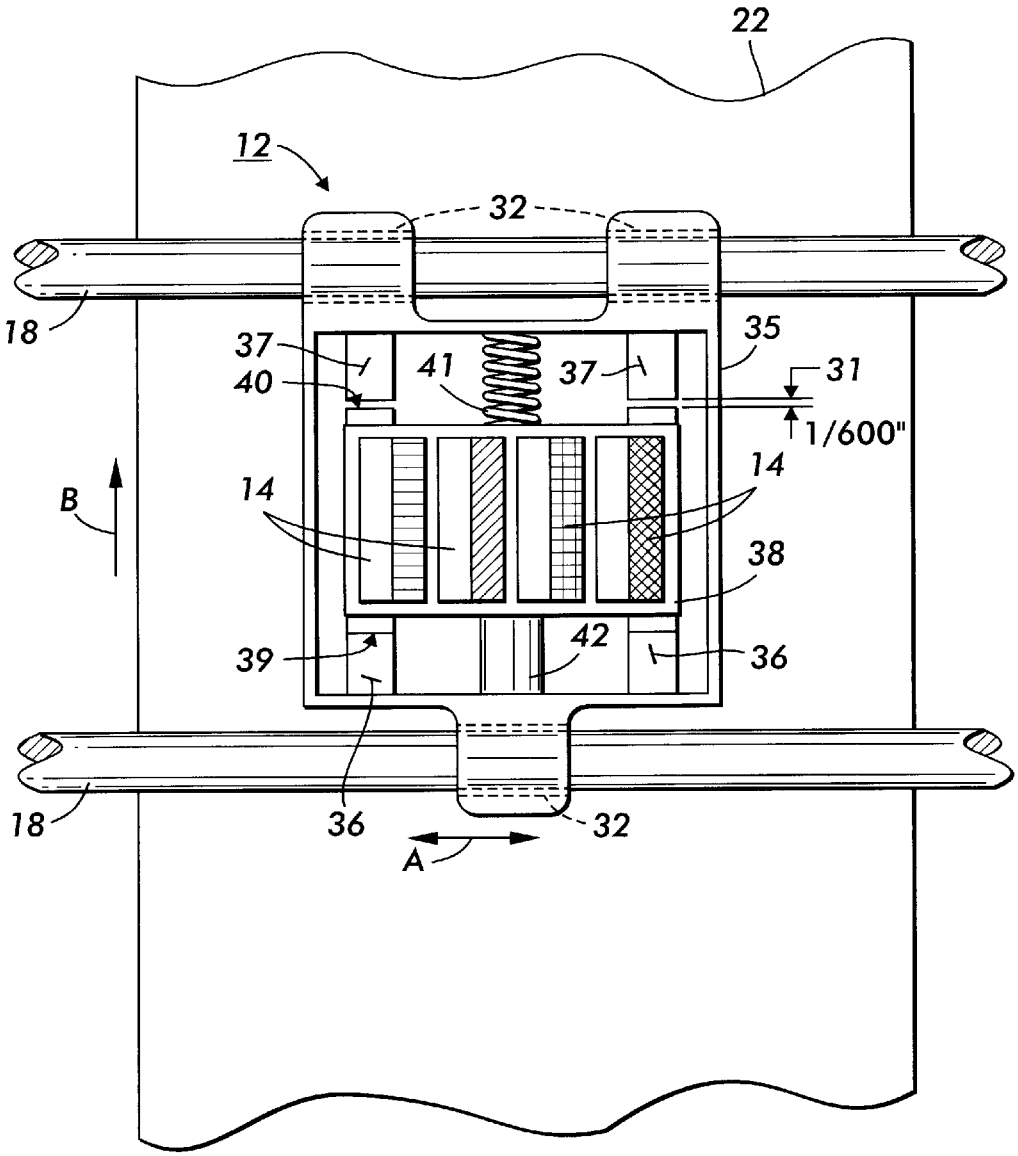
FIG. 3 illustrates another view of an exemplary embodiment of the carriage, one fluid-ejector structure and support rails according to this invention.

FIG. 3 shows the related structures for performing the motions of the fluid ejectors 14 and the fluid ejector carriage 12 according to the first exemplary embodiment of this invention. As shown in FIG. 2, the fluid ejectors 14 are located within the fluid ejector frame 38 and the interposer frame 35, which is mounted upon the fluid ejector carriage 12. The fluid ejector carriage 12 is movably mounted upon support rails 18 via a number of bearings 32. The fluid ejector frame 38 is shown, for example, in the first position. The gap 31, which is, for example, 1/600 inch, is located between the protruding surfaces 37 and the locator surfaces 40 of the interposer frame 35 and the fluid ejector frame 38, respectively. A first swath of fluid droplets is ejected from fluid ejectors 14 as the fluid ejector frame 38 and fluid ejector carriage 12 moves, for example, from left to right, across a recording medium 22 along the fast scan direction, or axis, A.

Upon completing the first swath, the fluid ejector frame 38 is urged by the position actuator 42 to the second position within the interposer frame 35. When in the second position, the gap 31 is no longer positioned between the protruding surfaces 37 and the locator surfaces 40. Instead the gap 31 is now positioned between the protruding surfaces 36 and the locator surfaces 39. Once the fluid ejector frame 38 is in the second position, a second swath of fluid droplets is ejected from fluid ejectors 14 as the fluid ejector frame 38 and fluid ejector carriage 12 again move across the recording medium 22 along the fast scan direction, or axis, A.

It should be appreciated that the fluid ejectors 14 place the droplets of fluid in swaths upon the receiving medium 22 according to the location and motions of the fluid ejector frame 38 and fluid ejector carriage 12 as the fluid ejectors 14, fluid ejector frame 38 and fluid ejector carriage 12 move along the support rails 18 across the receiving medium 22. Thus, a first swath of fluid droplets may be placed upon the receiving medium 22 as the one or more fluid ejectors 14 move, for example, from left to right across the receiving medium 22 along the fast scan direction, or axis, A. Thus, upon completing the first swath of fluid droplets, the second swath of fluid droplets are placed upon the receiving medium 22 by moving the fluid ejectors 14, fluid ejector frame 38 and fluid ejector carriage 12, for example, from right to left across the receiving medium 22 along the fast scan direction, or axis, A.

Alternatively, to perform the second swath the fluid ejectors 14, fluid ejector frame 38 and fluid ejector carriage 12 are returned to, for example, the left-most position along the rails 18 upon completing the first swath. Thus, the second swath of fluid droplets is placed upon the receiving medium 22 by moving the fluid ejectors 14, fluid ejector frame 38 and fluid ejector carriage 12 from left to right across the receiving medium 22 along the fast scan direction, or axis, A similar to the manner in which the first swath of fluid droplets was placed upon the receiving medium 22.

In either case, upon completing, for example, the second, or subsequent, swath, the receiving medium 22 is advanced in the slow-scan, or process, direction B perpendicular to the fast scan direction, or axis, A. Of course, the orientations of the fast scan direction, or axis, A and the process direction B are exemplary only, and other orientations relative to one another are contemplated as within the scope and spirit of the invention.

While the spring 41 is shown as the biasing member in FIGS. 2 and 3, any appropriate known or later developed structure may be used to urge the fluid ejector frame 38 to one of the first and second positions.

Further, it should be appreciated that the position actuator 42 identified above is exemplary only. Any appropriate known or later developed structure or combination of structures may be used to urge the fluid ejector frame 38 from the one of the first and second positions to the other of the first and second positions, similarly, to the actuator 42 set forth in the exemplary embodiment described above.

Still further, it should be appreciated that a single actuator, such as for example, a piezo-electric actuator may be used to perform the position actuating and biasing functions that have otherwise been described as individually performed by the position actuator 42 and biasing elements, such as for example, springs 41.

Figure 4:
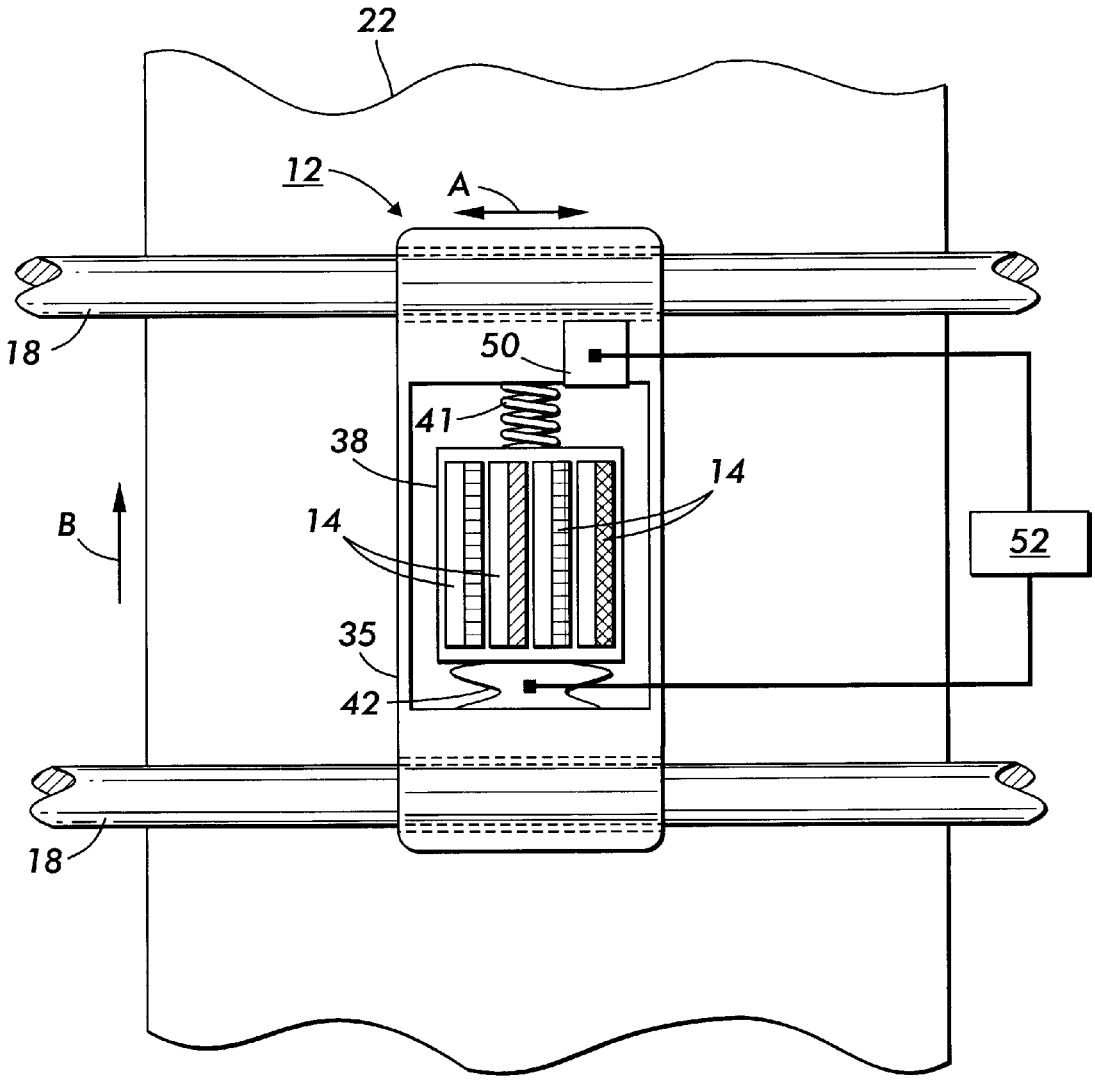
FIG. 4 illustrates another exemplary embodiment using displacement sensors and a processing system according to this invention.

FIG. 4 shows another exemplary embodiment of the systems and methods according to this invention. The exemplary embodiment shown in FIG. 4 includes, for example, a sensor 50 that accurately detects the position, or displacement, of the receiving medium 22 before, during and/or after a swath of fluid droplets is placed upon the receiving medium 22. The displacement data received by the sensor 50 is communicated to a processor 52, which adjusts the position of the one or more fluid ejectors 14 by adjusting the fluid ejector frame 38 relative to the receiving medium 22. At least one biasing element, such as, for example, the one or more springs 41, and the actuator 42 cooperate to urge the fluid ejector frame 38 to a desired position, such as, for example, from which fluid droplets are ejected from the one or more fluid ejectors 14 onto the receiving medium 22.

Upon completing the first swath, for example, the sensor 50 determines the position of the fluid ejector frame 38 relative to the receiving medium 22. The position information is transmitted to the processor 52, which determines an amount of movement of the fluid ejector frame 38 desirable to adjust the position of the fluid ejector frame 38 so that a next swath of fluid droplets is accurately placed upon the receiving medium 22. The determined adjustment of the processor 52 is relayed to one or more position actuators 42 that energize to move the fluid ejector frame 38 according to the determined adjustment.

Of course, it should be appreciated that the configuration illustrated in FIG. 4 could as well provide that the sensor 50 detects the position of the one or more fluid ejectors 14 within the fluid ejection frame 38 relative to the fixed frame 12, rather than relative to the receiving medium 22. The fluid ejector frame 38 and the one or more fluid ejectors 14 could be incrementally positioned relative to the fixed frame 12 according to the position detection by the sensor 50 and as urged by the position actuator 42. As a result, the same or similar print addressibility can be achieved.

Thus, in contrast to the first exemplary embodiment outlined above with respect to FIGS. 1 and 2, no locating surfaces 39, 40 or protruding surfaces 36, 37 are used to limit the position the fluid ejector frame 38 may be placed into by, for example, the biasing element 41 or the position actuator 42. Accordingly, greater sensitivity or variations in the position of the fluid ejector frame 38 in the slow scan direction B relative to the receiving medium 22 can be obtained to achieve the desired fluid droplet coverage on the receiving medium 22 desired. For example, the fluid ejector frame 38 may be moved in increments, such as, for example, 1/150", 1/300", 1/600", 1/1200," etc., to vary the print addressibility in the slow scan direction.

Similarly to the first exemplary embodiment, in this second exemplary embodiment, the receiving medium 22 remains stationary as the fluid ejector frame 38 and fluid ejector carriage 12 move from one position to another position. Upon completing, for example, a second swath of fluid droplets placed upon the receiving medium 22, the receiving medium 22 is advanced a designated distance in the processing direction B. Then, the sensing and adjusting of the fluid ejector frame 38, relative to the receiving medium 22, is repeated until the desired fluid droplet coverage upon the receiving medium 22 is achieved. Alternatively, in other exemplary embodiments, only the fluid ejector frame 38 is moved relative to a fixed fluid ejector carriage 12 while the receiving medium 22 remains stationary until the desired fluid droplet coverage upon the receiving medium 22 is achieved.

Figure 5:
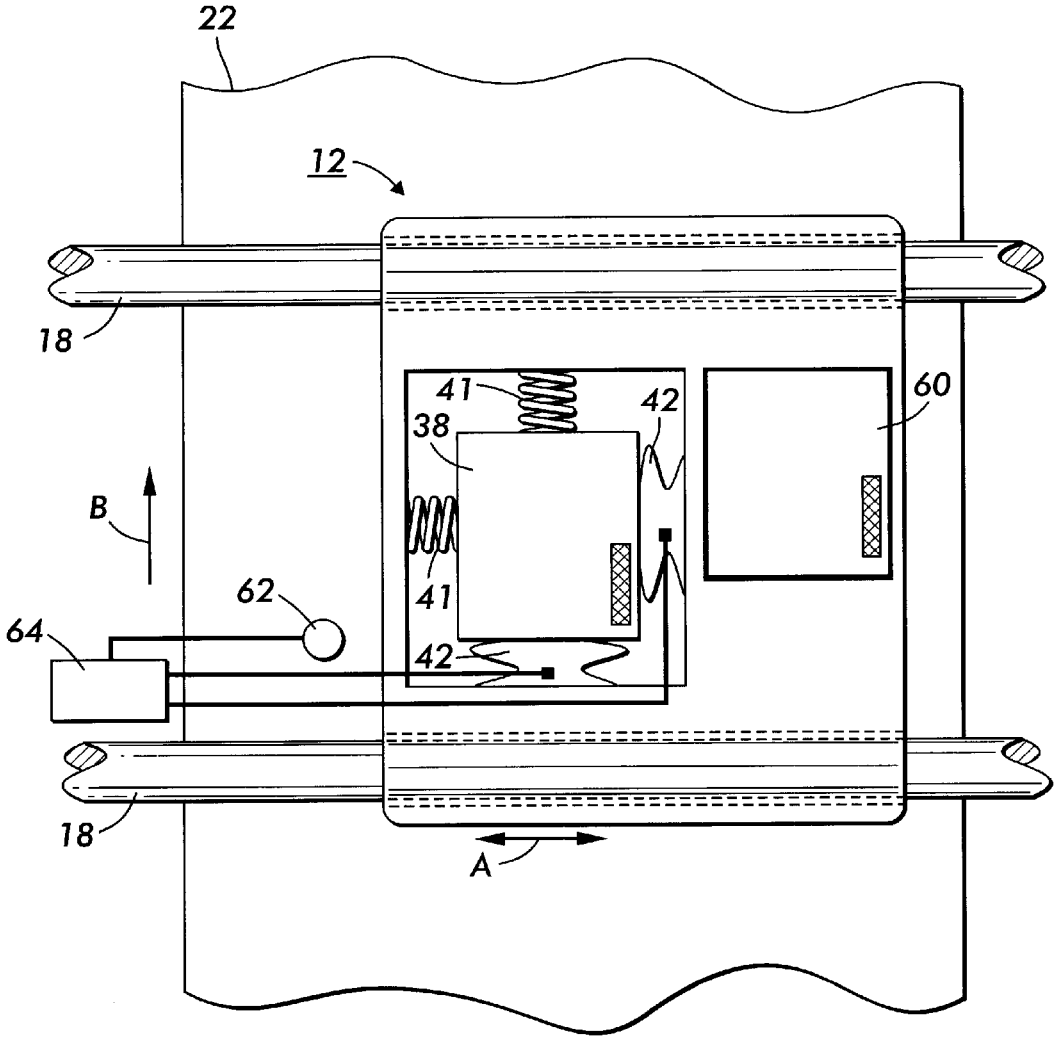
FIG. 5 illustrates another exemplary embodiment using a fixed fluid ejector and an adjustable fluid ejector according to this invention.

FIG. 5 shows yet a third exemplary embodiment of the systems and methods according to this invention. The third exemplary embodiment shown in FIG. 5 includes a fixed fluid ejector frame 60 and an adjustable fluid ejector frame 38. The adjustable fluid ejector frame 38 is movably adjusted by a pair of biasing elements, such as, for example, one or more springs 41 provided on one pair of adjacent sides of the adjustable fluid ejector frame 38. A corresponding pair of position actuators 42 are provided on the other pair of adjacent sides of the adjustable fluid ejector frame 38. The pair of biasing elements, for example, the one or more springs 41, and the pair of position actuators 42 are thus disposed between the fluid ejector frame 38 and the fluid ejector carriage 12.

It should be appreciated that the biasing elements may be on the same side as the position actuators. Further, the biasing elements may be "combined" with the position actuators, such as, for example, where at least one spring is adjacent to, or is around, the biasing element. Still further, the biasing elements may be integral with the position actuators, wherein the biasing function is also performed by the position actuators.

A receiving medium 22 is positioned to receive fluid droplets ejected from fluid ejectors within the fixed fluid ejector frame 60 and the adjustable fluid ejector frame 38. The recording medium is stationary while the fluid droplets are ejected from the fluid ejectors within the fixed fluid ejector frame 60 and the adjustable fluid ejector frame 38. However, the receiving medium 22 is advanced in the processing direction B when a swath of ejected fluid droplets of a desired width in the fast scan direction, or axis, A across the receiving medium 22 is completed.

A control system 64 connected to a sensor 62 monitors the position of the adjustable fluid ejector frame 38 relative to the fixed fluid ejector frame 60 as fluid droplet ejection in swaths upon the receiving medium 22 occurs. For example, after the fluid ejectors within the fixed fluid ejector frame 60 eject an initial swath of fluid droplets upon the receiving medium 22, the sensor 62 determines the location the adjustable fluid ejector frame 38 must assume to align the second, or subsequent, swath of fluid droplets with the initial, or preceding, swath of fluid droplets ejected upon the receiving medium 22. The controller 64 therefore energizes the position actuators 42 to move the adjustable fluid ejector frame 38 to the desired location. As a result, the fluid ejector 38 may be moved in increments, such as, for example, $1/150$", $1/300$", $1/600$", $1/1200$", etc., to vary the print addressibility in the slow scan direction B.

The position actuators 42 move the adjustable fluid ejector frame 38 in either, or both, of the processing direction B and fast scan direction, or axis, A. The biasing elements, for example springs 41, act in compliance with the position actuators 42 to position the adjustable fluid ejector frame 38 appropriately relative to the fixed fluid ejector frame 60. Once the adjustable fluid ejector frame 38 has reached the desired location, the second, or subsequent, swath of fluid droplets is ejected upon the receiving medium 22. As a result, the second, or subsequent, swath of fluid droplets ejected upon the recording medium is in appropriate alignment with the initial, or preceding, swath of fluid droplets.

Thus, again in contrast to the first embodiment, the alignment of the adjustable fluid ejector frame 38 of the third embodiment is achieved without the locating surfaces 39 and 40 or the protruding surfaces 36 and 37. Instead, the control system 64 moves the adjustable fluid ejector frame 38 in the processing direction B and fast scan direction, or axis, A by energizing the position actuators 42 to position the adjustable fluid ejector frame 38 appropriately.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A fluid ejecting system usable to eject fluid onto a receiving medium, comprising:

a first support movable in a first direction relative to the receiving medium;

a first frame supported by the first support;

at least one fluid ejector device supported within the first frame such that the at least one fluid ejector device is movable in a second direction different than the first direction;

at least one actuator located between the first frame and the at least one fluid ejector device and usable to move the at least one fluid ejector device in at least the second direction relative to the first frame;

at least one biasing element, wherein at least one actuator is located on a first side of the first frame, at least one of the at least one biasing element is located on a second side of the frame opposite that at least one actuator, and the at least one biasing element is a spring; and at least one second biasing element, wherein the at least one second biasing element is a piezoelectric element.

2. The fluid ejecting system of claim 1, further comprising:

a sensor that outputs a signal indicative of a fluid ejecting position of the at least one fluid ejector device relative to the first frame; and a controller that inputs the signal and that controllably actuates the at least one actuator to move the at least one fluid ejector device to a desired position relative to the first frame.

3. The fluid ejecting system of claim 1, wherein the first support and the first frame are integral.

4. A fluid ejecting system usable to eject fluid onto a receiving medium, comprising:

a first support movable in a first direction relative to the receiving medium;

a first frame supported by the first support;

at least one fluid ejector device supported within the first frame such that the at least one fluid ejector device is movable in a second direction different than the first direction;

at least one actuator located between the first frame and the at least one fluid ejector device and usable to move the at least one fluid ejector device in at least the second direction relative to the first frame;

a second frame containing the at least one fluid ejector device;

at least a first actuator and a second actuator located on adjacent sides between the first frame and the second frame, such that the second frame and the at least one fluid ejector device are movable in the first direction and the second direction relative to the first frame; and at least a first biasing element and a second biasing element corresponding to the at least first and second actuators, the first and second biasing elements being on adjacent sides opposite the corresponding at least first and second actuators.

5. The fluid ejecting system of claim 4, wherein at least one of the first and second biasing elements is at least one spring.

6. The fluid ejecting system of claim 4, wherein the first support and the first frame are integral.

7. The fluid ejecting system of claim 4, further comprising:

a sensor that outputs a signal indicative of a fluid ejecting position of the at least one fluid ejector device relative to the first frame; and a controller that inputs the signal and that controllably actuates at least one of the at least first and second actuators to move the second frame and the at least one fluid ejector device to a desired position relative to the first frame.

8. The fluid ejecting system of claim 4, further comprising:

a sensor that outputs a signal indicative of a fluid ejecting position of the at least one fluid ejector device relative to the receiving medium; and a controller that inputs the signal and that controllably actuates at least one of the at least first and second actuators to move the second frame and the at least one fluid ejector, or device to a desired position relative to the receiving medium.

9. The fluid ejecting system of claim 4, wherein the at least one biasing element is a spring.

10. A fluid ejecting system usable to eject fluid onto a receiving medium, comprising:

a first support movable in a first direction relative to the receiving medium;

a first frame supported by the first support;

at least one fluid ejector device supported within the first frame such that the at least one fluid ejector device is movable in a second direction different than the first direction;

at least one actuator located between the first frame and the at least one fluid ejector device and usable to move the at least one fluid ejector device in at least the second direction relative to the first frame;

a second frame containing the at least one fluid ejector device;

at least a first actuator and a second actuator located on adjacent sides between the first frame and the second frame, such that the second frame and the at least one fluid ejector device are movable in the first direction and the second direction relative to the first frame; and at least a first biasing element and a second biasing element associated with the at least first actuator and the second actuator, respectively, the at least one first biasing element and the second biasing element positioned on the same sides as the at least one associated first actuator and second actuator, respectively, to move the at least one fluid ejector relative to the frame.

11. The fluid ejecting system of claim 10, wherein the first support and the first frame are integral.

12. The fluid ejecting system of claim 10, further comprising:

a sensor that outputs a signal indicative of a fluid ejecting position of the at least one fluid ejector device relative to the first frame; and a controller that inputs the signal and that controllably actuates the at least one actuator to move the at least one fluid ejector device to a desired position relative to the first frame.

13. The fluid ejecting system of claim 10, wherein the at least one biasing element is a spring.

14. A fluid ejecting system usable to eject fluid onto a receiving medium, comprising:

a first support movable in a first direction relative to the receiving medium;

a first frame supported by the first support;

at least one fluid ejector device supported within the first frame such that the at least one fluid ejector device is movable in a second direction different than the first direction;

at least one actuator located between the first frame and the at least one fluid ejector device and usable to move the at least one fluid ejector device in at least the second direction relative to the first frame;

a sensor that outputs a signal indicative of a fluid ejecting position of the at least one fluid ejector device relative to the receiving medium; and a controller that inputs the signal and that controllably actuates the at least one actuator to move the at least one fluid ejector device to a desired position relative to the receiving medium.

15. The fluid ejecting system of claim 14, further comprising a second frame containing the at least one fluid ejector device and having at least one locator surface, wherein the first frame includes at least one protruding surface corresponding to each at least one locator surface provided on the second frame and located on the first frame opposite one of the at least one protruding surface.

16. The fluid ejecting system of claim 14, wherein:

each of the at least one fluid ejector device has at least one locator surface; and the first frame includes at least one protruding surface corresponding to each at least one locator surface provided on the second frame and located on the first frame opposite one of the at least one protruding surface.

17. The fluid ejecting system of claim 14, wherein:

each of the at least one fluid ejector device has at least one locator surface; and the first frame includes at least one protruding surface corresponding to each at least one locator surface on each of the at least one fluid ejector device and located on the first frame opposite one of the at least one protruding surface.

18. The fluid ejecting system of claim 14, wherein the at least one actuator is at least one biasing element that moves the at least one fluid ejector device relative to the first frame.

19. The fluid ejecting system of claim 18, wherein the first support and the first frame are integral.

20. The fluid ejecting system of claim 14, wherein the at least one biasing element is a spring.

* * * * *